US011648163B2

(12) United States Patent
Olsson et al.

(10) Patent No.: US 11,648,163 B2
(45) Date of Patent: May 16, 2023

(54) SIZE ADJUSTABLE SLING

(71) Applicant: Liko Research & Development AB, Lulea (SE)

(72) Inventors: Karin Olsson, Sodra Sunderbyn (SE); Roger Karlsson, Rosvik (SE); Neal Wiggermann, Batesville, IN (US); John Christie, Batesville, IN (US); Elin Dovervik, Lulea (SE); Jean-Bernard Duvert, Auray (FR); Johan Lyckestig, Lulea (SE); Clementine Pirio, Vannes (FR)

(73) Assignee: Liko Research & Development AB, Lulea (SE)

( * ) Notice: Subject to any disclaimer, the term of this patent is extended or adjusted under 35 U.S.C. 154(b) by 93 days.

(21) Appl. No.: 17/142,689

(22) Filed: Jan. 6, 2021

(65) Prior Publication Data

US 2021/0121348 A1 Apr. 29, 2021

Related U.S. Application Data

(62) Division of application No. 15/629,032, filed on Jun. 28, 2017, now Pat. No. 10,918,548.

(Continued)

(51) Int. Cl.
*A61G 7/10* (2006.01)

(52) U.S. Cl.
CPC ..... *A61G 7/1051* (2013.01); *A61G 7/1015* (2013.01); *A61G 7/1019* (2013.01);

(Continued)

(58) Field of Classification Search
CPC ..... A61G 2200/34; A61G 7/1061; A61G 7/1051; A61G 7/1042; A61G 7/1019; A61G 7/1015

See application file for complete search history.

(56) References Cited

U.S. PATENT DOCUMENTS 1,035,642 A 8/1912 Rosse
2,477,164 A * 7/1949 Bergman ..... A47D 13/025 224/159

(Continued)

FOREIGN PATENT DOCUMENTS

CN 201710353 U 1/2011
CN 202819689 U 3/2013

(Continued)

OTHER PUBLICATIONS

Photos of Watershoe and Enlargements Thereof: Source: http://www.swimoutlet.com/p/speedo-mens-seaside-ace-40-water-shoes-8135911/?utm_source=goggle&utm_medium=cpc&utm_campaign+google-shopping&color=48720&size=1117&gclid=CjOKEQjwg47KBRDk7LSu4LTD8eEBEiQAO4O6r-OqjAlyNVtbX523ZFCIW6N3NqO-7_r9oLWqU6uUUfkaAgFk8P8HAQ.

*Primary Examiner* — David R Hare
*Assistant Examiner* — Alexis Felix Lopez
(74) *Attorney, Agent, or Firm* — Dinsmore & Shohl LLP

(57) ABSTRACT

A sling for supporting a subject such as a patient includes a panel assembly including a left flank with a left end, a right flank with a right end, and an interflank panel. The interflank panel has a left extremity permanently joined to the left end of the left flank and a right extremity permanently joined to the right end of the right flank. The sling also includes a left closure element and a right closure element which are securable to each other and releasable from each other to adjust an effective dimension of the sling. In another embodiment, the sling includes a frangible closure member which secures the left flank to the right flank.

8 Claims, 17 Drawing Sheets

Related U.S. Application Data

(60) Provisional application No. 62/513,481, filed on Jun. 1, 2017.

(52) U.S. Cl.
CPC ..... *A61G 7/1042* (2013.01); *A61G 7/1061* (2013.01); *A61G 2200/34* (2013.01)

(56) References Cited

U.S. PATENT DOCUMENTS

| | | | | |
|---|---|---|---|---|
| 2,788,530 | A | 4/1957 | Ferguson | |
| 3,252,704 | A | 5/1966 | Wilson | |
| 3,469,914 | A | 9/1969 | Thomson | |
| 5,733,014 | A | 3/1998 | Murray | |
| 9,198,525 | B2 | 12/2015 | Wernick et al. | |
| 9,375,037 | B1 | 6/2016 | Clark | |
| 9,420,832 | B2 | 8/2016 | Arnold | |
| 9,433,544 | B1 * | 9/2016 | Ross | A41D 15/04 |
| 9,986,849 | B2 | 6/2018 | Sclare | |
| 2004/0225271 | A1 * | 11/2004 | Datta | A61F 13/5644 604/385.11 |
| 2005/0077200 | A1 * | 4/2005 | Tippey | B65D 21/08 206/440 |
| 2008/0189853 | A1 | 8/2008 | Felling | |
| 2011/0264021 | A1 | 10/2011 | Hettich | |
| 2013/0116604 | A1 | 5/2013 | Morrilla et al. | |
| 2013/0205466 | A1 | 8/2013 | Arnold | |
| 2014/0276274 | A1 | 9/2014 | Clare et al. | |
| 2015/0136145 | A1 | 5/2015 | Binder | |
| 2016/0015584 | A1 | 1/2016 | Choudhury et al. | |

FOREIGN PATENT DOCUMENTS

| | | | | |
|---|---|---|---|---|
| CN | 203058311 | U | 7/2013 | |
| CN | 204562519 | U | 8/2015 | |
| CN | 205106439 | U | 3/2016 | |
| EP | 1600132 | A1 * | 11/2005 | A61F 13/15756 |
| GB | 2432297 | A | 5/2007 | |
| GB | 2466304 | A | 6/2010 | |
| KR | 379458 | Y1 | 3/2005 | |
| KR | 101512957 | B1 * | 4/2015 | |

* cited by examiner

SIZE ADJUSTABLE SLING

CROSS REFERENCE TO RELATED APPLICATION

This application is a Divisional Application of U.S. Non-provisional application Ser. No. 15/629,032, filed on Jun. 28, 2017, which claims priority to U.S. provisional application 62/513,481 filed on Jun. 1, 2017, the contents of which are incorporated herein by reference.

TECHNICAL FIELD

The subject matter described herein relates to slings used as part of a sling assembly for nonambulatory persons, and more particularly to a size adjustable sling.

BACKGROUND

Caregivers in hospitals and other health care facilities may employ various devices to transport patients with severely limited mobility, or to assist those patients in their efforts to move about on their own. One such device is a sling assembly. A sling assembly includes a sling made of cloth or other material suitable for cradling the patient. The sling typically includes two or more loops. One example of a sling assembly also includes a carriage which is supported near the ceiling of the facility by a ceiling mounted rail system. The sling assembly also includes a deployable and extendable tether extending downwardly from the carriage. The sling assembly also includes a slingbar attached to the lower end of the tether. The slingbar includes hooks which receive the loops of the sling.

In typical practice, a caregiver maneuvers the sling under the patient, for example underneath a patient lying on a bed. The caregiver then hooks the sling loops onto the slingbar hooks. The caregiver operates a carriage mounted motor to retract the tether into the carriage until the patient is suspended a suitable distance above the bed and floor. The caregiver can then pull on the sling, causing the carriage to move along the rail system until the patient is positioned in the vicinity of a destination, for example a chair. The caregiver then operates the motor to extend the tether out of the carriage in order to deposit the patient on the chair, after which the caregiver can disconnect the sling from the slingbar hooks and maneuver the sling from under the patient. Alternatively the caregiver can deposit the patient near the chair in a standing posture, disconnect the sling from the hooks, place the sling aside, and assist the patient into the chair.

Sling assemblies as just described have many merits. However one drawback is that the dimensions of a given model of sling may not be suitable for patients of all sizes (height, weight, girth, morphology) or even for a wide range of patient sizes and/or may not be suitable for all clinical situations. In other words, the concept of "one size fits all" does not apply, or at least involves considerable compromise. For example if the lateral dimension of the sling (the left to right dimension from the patient's perspective) is too small, the patient will feel squeezed across his shoulders and/or torso when suspended in the sling. If the lateral dimension of the sling is too large, the patient may feel inadequately supported, for example the patient may feel side to side instability or may feel a lack of support in his lower back.

One way to address the sling/patient sizing problem is to manufacture a sling with a variety of loops. When attaching the sling to the slingbar hooks, the caregiver selects the sling loops most suitable for the patient size or clinical situation of interest. For example loops that are more widely laterally separated may be more suitable for a patient of large girth, while loops that are less widely separated may be more satisfactory for a smaller patient.

Although the multi-loop solution may have merit, the presence of numerous loops may increase the likelihood that a loop might inadvertently snag on a nearby object during patient transport, causing delay and inconvenience.

Another way to address the sling/patient sizing problem is for the sling manufacturer to offer a multitude of differently sized slings, smaller slings for smaller patients; larger slings for larger patients. The multiple sling solution has the disadvantage that the health care facility needs to purchase a variety of slings and the caregiver is faced with the challenge of selecting the correct size sling for each individual from the numerous sizes available.

It is therefore desirable to provide a single sling which will accommodate all (or a very wide range) of patients and clinical situations or a sling which can be offered in a very small number of different sizes which, taken collectively, accommodate all (or a very wide range) of patients and clinical situations.

SUMMARY

A sling for supporting a subject includes a a left flank with a left end, a right flank with a right end, and an interflank panel. The interflank panel has a left extremity permanently joined to the left end of the left flank and a right extremity permanently joined to the right end of the right flank. The sling also includes left and right closure elements which are securable to each other and releasable from each other to adjust an effective dimension of the sling.

BRIEF DESCRIPTION OF THE DRAWINGS

The foregoing and other features of the various embodiments of the patient support sling described herein will become more apparent from the following detailed description and the accompanying drawings in which.

DETAILED DESCRIPTION

Figure 1:
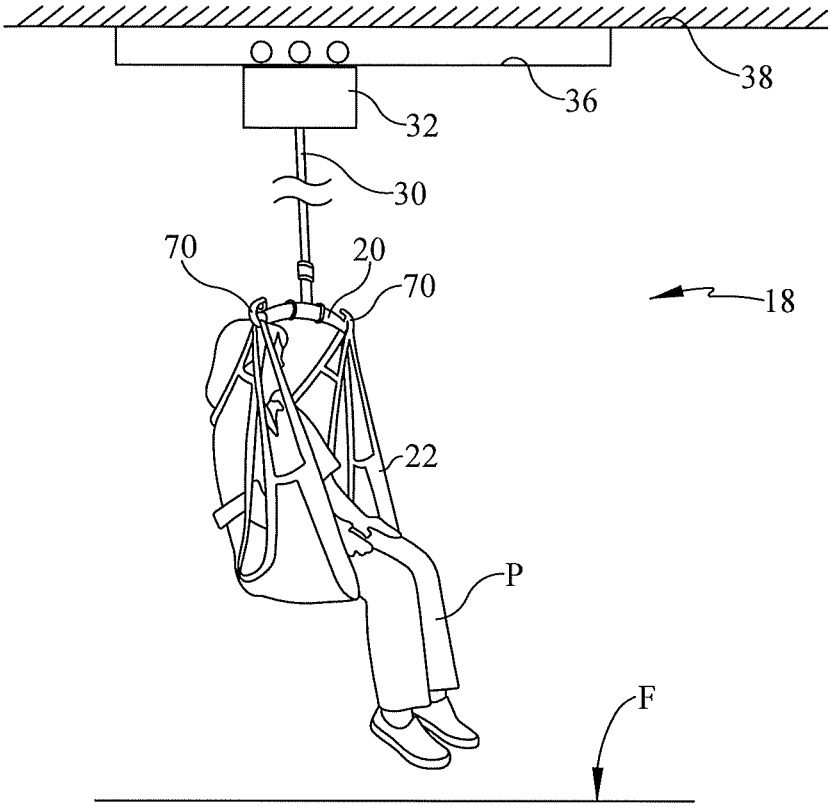
FIG. 1 PRIOR ART
FIG. 1 is a perspective view of a conventional sling assembly comprised of a slingbar and a fixed dimension patient support sling attached to the slingbar.

Reference will now be made to embodiments of the invention, examples of which are illustrated in the accompanying drawings. Features similar to or the same as features already described may be identified by reference numerals which are the same as or similar to those already used.

FIG. 1 shows a sling assembly 18 which includes slingbar 20, a representative, fixed dimension patient support sling 22 attached to the slingbar, and a subject or patient P seated in the sling. A tether 30 extends upwardly from the slingbar to a carriage 32. The carriage includes a motor and other components so that operation of the motor retracts the tether into the interior of the carriage in order to raise the patient away from floor F, or deploys the tether out of the carriage in order to lower the patient toward the floor. The carriage is mounted on a rail 36 of a rail system. The rails of the rail system are secured to a ceiling beam 38 so that the patient can be moved horizontally.

Figure 2:
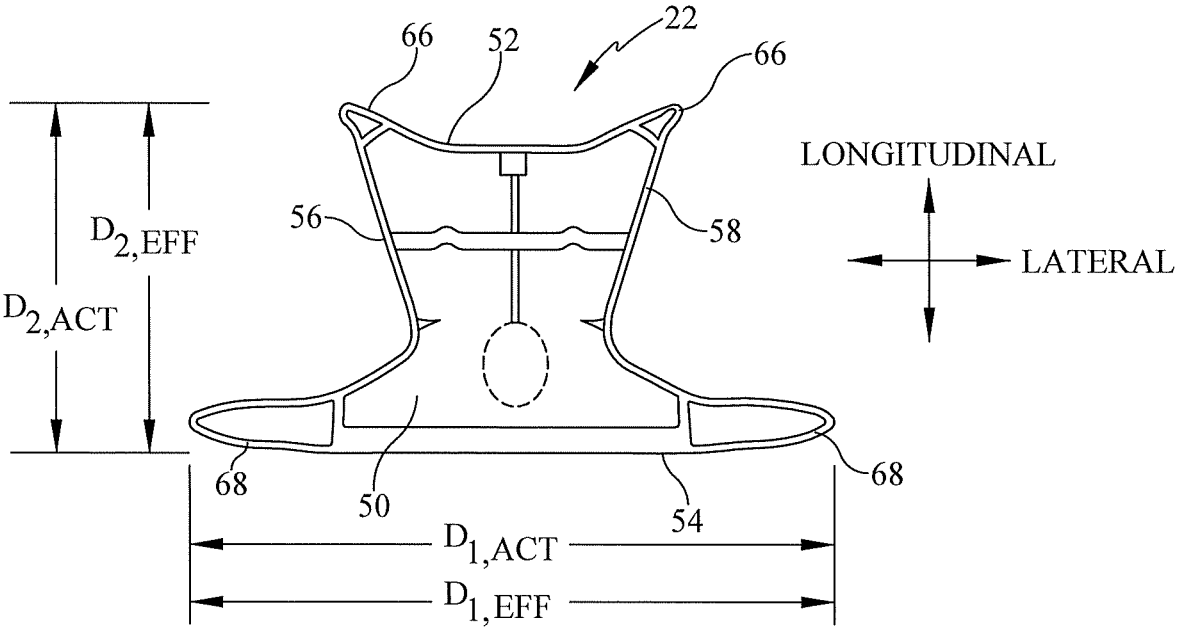
FIG. 2 PRIOR ART
FIG. 2 is a plan view of the back face of the sling of FIG. 1, laid flat.

Referring additionally to FIG. 2, the fixed dimension sling includes a fabric patient support panel assembly 50 for cradling the patient. The drawing shows the back face of the sling, i.e. the face that faces away from the patient being supported. The opposite face is referred to as the front or patient face PF. The panel assembly extends longitudinally from an upper edge 52 to a lower edge 54 and laterally from a left edge 56 to a right edge 58. Upper and lower loops 66, 68 extend from the panel assembly. When in use, the support loops are hooked onto hooks 70 on the slingbar as seen in FIG. 1.

The conventional sling of FIGS. 1-2 has an actual lateral dimension $D_{1,ACT}$ and an effective lateral dimension $D_{1,EFF}$. The actual and effective lateral dimensions of the illustrated sling are the distance from left edge 52 to right edge 54. Both dimensions vary in the longitudinal direction. However at any given longitudinal coordinate, the effective lateral dimension is the same as the actual lateral dimension even when the weight of a patient places the sling under tension.

The sling also has an actual longitudinal dimension $D_{2,ACT}$ and an effective longitudinal dimension $D_{2,EFF}$. The actual and effective lateral dimensions of the illustrated sling are the distance from upper edge 56 to lower edge 58. Both dimensions vary in the lateral direction. However at any given lateral coordinate, the effective longitudinal dimension is the same as the actual longitudinal dimension even when the weight of a patient places the sling under tension.

As noted previously, fixed dimension slings, such as the one just described, may not be suitable for all patients or clinical situations, or even for a broad range of patients and clinical situations. Existing ways of accommodating the drawbacks of fixed dimension slings may introduce problems of their own.

Figure 3:
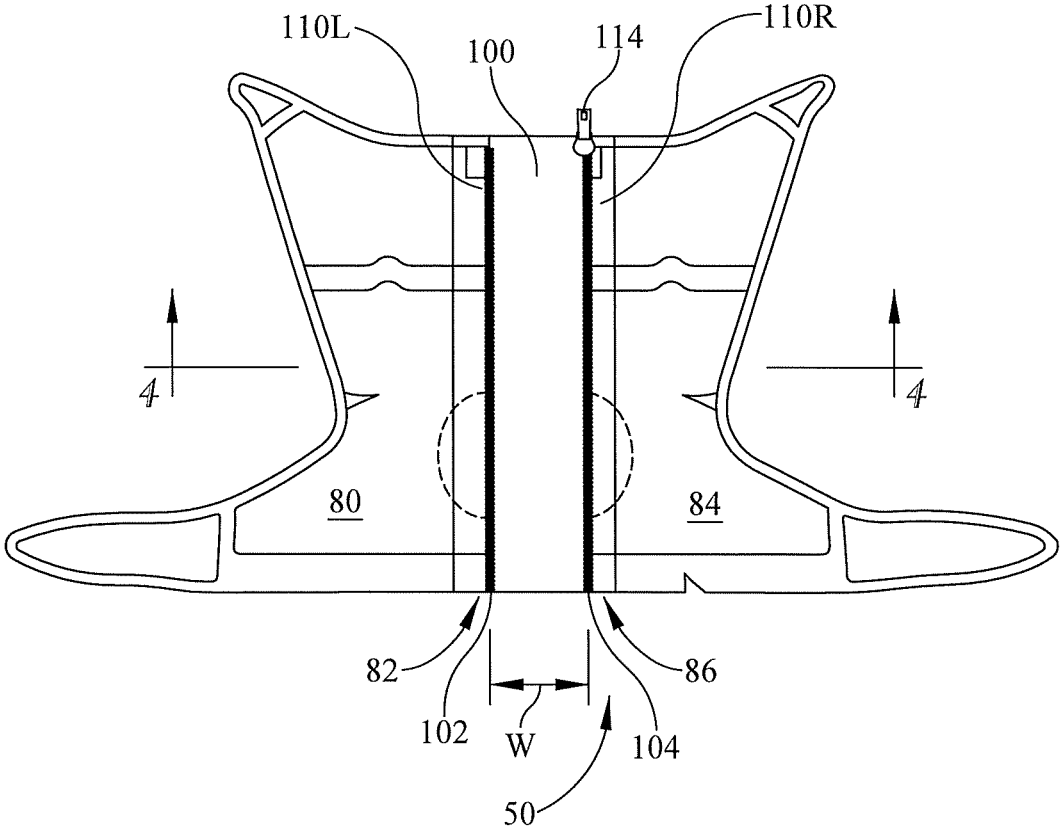
FIG. 3 is a back side plan view of a sling as described herein, laid flat, and showing left and right flanks and an interflank panel in the form of a substantially continuous sheet of material and also showing a closure comprising left and right closure elements.
Figure 4:
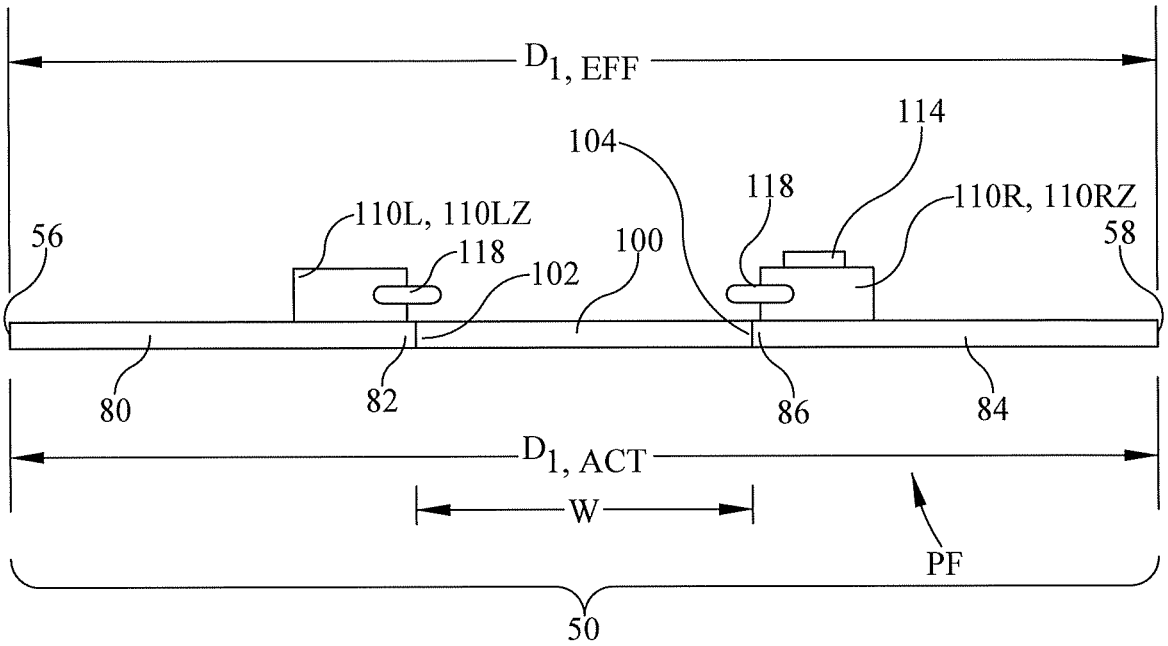
FIG. 4 is an enlarged cross sectional view in the direction 4-4 of FIG. 3 with the closure elements released from each other so that the effective lateral dimension of the sling is an open dimension.
Figure 5:
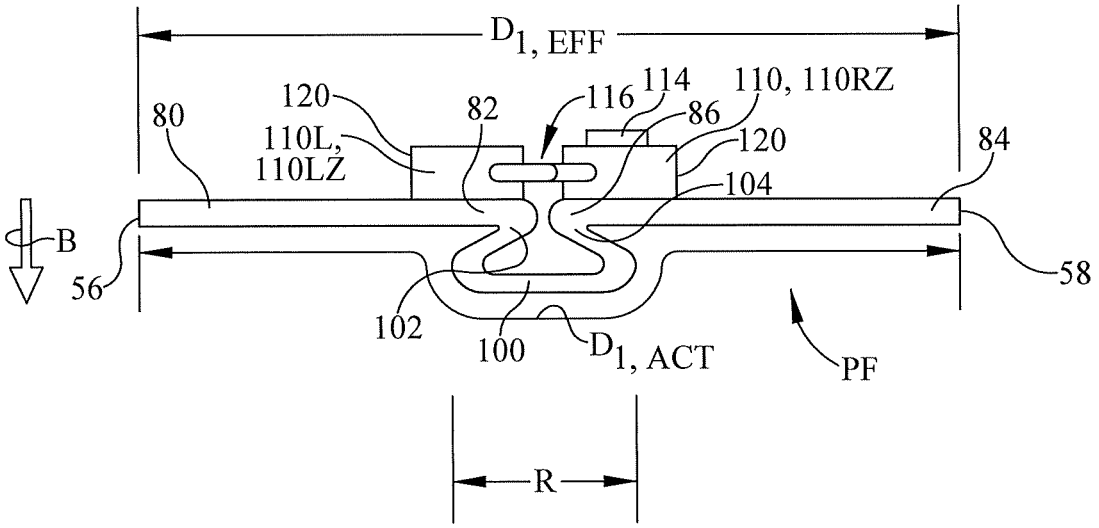
FIG. 5 is an enlarged cross sectional view similar to that of FIG. 4 with the left and right closure elements secured to each other so that the effective lateral dimension of the sling is a closed dimension which is smaller than the open dimension.

FIGS. 3-5 are views of one embodiment of a sling as disclosed herein. FIG. 3 is a view of the back face of the sling, which is the face that faces away from the patient. The opposite face is the patient facing face and is indicated as PF in FIGS. 4-5. The sling includes a panel assembly 50 including a left flank 80 with a left end 82, a right flank 84 with a right end 86, and an interflank panel 100. The interflank panel has a left extremity 102 permanently joined to the left end 82 of the left flank 80 and a right extremity 104 permanently joined to the right end 86 of the right flank 84. The interflank panel has a width W which is the distance from the left extremity to the right extremity. As used in this specification, including the accompanying claims, "left" and "right" are used as, and should be interpreted as, terms of distinction rather than terms of direction even though in most of the examples "left" and "right" happen to also correspond to directions.

The sling also includes a left closure element 110L and a right closure element 110R. The example closure elements are zip halves 110LZ, 110RZ, one of which includes a zip slider 114. Taken collectively, the zip halves and zip slider comprise a zipper 116.

The closure elements are securable to each other (FIG. 5) so that the effective lateral dimension $D_{1,EFF}$ is a relatively smaller closed dimension. The closure elements are also releasable from each other (FIGS. 3-4) so that the effective lateral dimension $D_{1,EFF}$ is an relatively larger dimension which is greater than the closed, relatively smaller dimension. Because the effective lateral dimension can be adjusted to two different discrete dimensions as seen by comparing FIG. 5 to FIGS. 3-4, the sling can accommodate a wider range of patients than would be the case if the sling were a nonadjustable, fixed dimensional sling. For example the sling adjusted as seen in FIG. 5 can be used for patients classified as "small" while the same sling adjusted as seen in FIGS. 3-4 can be used for patients classified as "large". The sling is designed so that when the closure elements are secured to each other and the sling is used as intended (to bear the weight of a patient within the rated load capacity of the sling) the closure elements will not separate from each other even though the sling is bearing a patient's weight (force of gravity) acting on the sling with a vertically downwardly oriented component.

"Securable to each other" as used in the foregoing paragraph and throughout this specification means that the closure elements can be engaged with each other without the assistance of an intervening component to keep the elements engaged. One example is the two zip halves of a zipper which interlock with each other when the zipper is closed or zipped. The zip slider is not considered to be an intervening component because although it effects the joinder and separation of the zip halves, it plays no role in maintaining the engagement of the zip halves with each other. Another example is a shirt button which interacts with material surrounding a buttonhole to resist passing through the buttonhole when the shirt is buttoned. "Securable to each other" also means that the closure elements can be drawn toward each other with the assistance of an intervening component. One example is left and right sides of a shoe, playing the role of two closure elements, which can be drawn toward each other by a shoelace (the intervening component) in order to prevent the wearer's foot from slipping inside the shoe or slipping out of the shoe. Unlike a zip slider which plays no role in maintaining the engagement of two zip halves, the shoelace plays a continuing role in keeping the left and right halves of a shoe drawn toward each other.

"Releasable from each other" as used throughout this specification is the opposite of "securable to each other", for example the way the two zip halves of a zipper can be disengaged from each other to open or unzip the zipper or the way a shirt button can be passed edgewise through its buttonhole to unbutton the shirt. In the case of closure elements that require the assistance of an intervening component, "releasable from each other" means the closure elements can be released from their previously selected drawn-together state.

FIGS. 3-5 show an example in which left flank 80, right flank 84, and interflank panel 100, are permanently joined to each other by virtue of being a continuous piece of material. Accordingly, the ends 82, 86 of the panel flanks and the extremities 102, 104 of the interflank panel are not distinct features but instead are locations for distinguishing between the interflank panel and the flanks. In FIGS. 4-5 the ends 82, 86 of the flanks and the lateral extremities 102, 104 of the interflank panel 100 are aligned with the operative edges 118 of the zip halves 110LZ, 110RZ (and are indicated for the convenience of the reader by light vertical hash marks superimposed on the panel assembly near the operative edges of the zip halves). "Permanently joined" means designed so that the flanks will not separate from the interflank panel under the influence of forces to which the joint is subjected when the sling is used for its intended purpose.

Figure 6:
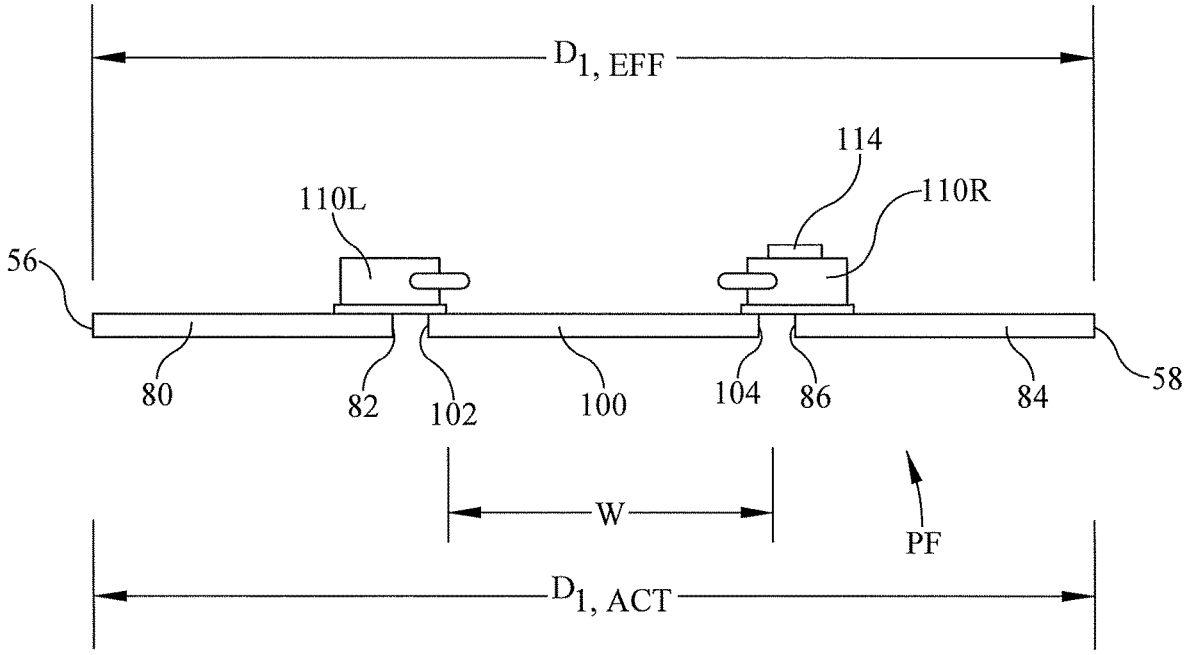
FIG. 6 is a view similar to that of FIG. 5 showing an alternate arrangement in which the left closure element joins the interflank panel to the left flank and the right closure element joins the interflank panel to the right flank.

FIG. 6 shows an alternate arrangement in which the left flank 80, right flank 84 and interflank panel 100 are recognizably distinct elements. The left flank 80 has a distinct left end 82, the right flank 84 has a distinct right end 86, and the interflank panel 100 has distinct left and right extremities 102, 104. Left zip half 110LZ overlies and is permanently joined to both the left flank 80 and the interflank panel 100. Right zip half 110RZ overlies and is permanently joined to both the right flank 84 and the interflank panel 100. As with the continuous material embodiment, "permanently joined" means designed so that the interflank panel and the flank will not separate from each other under the influence of forces to which the sling is subjected when the sling is used for its intended purpose.

In the example of FIGS. 3-6, the dimension of interest is the lateral dimension. With the closure elements secured to each other as in FIG. 5, the interflank panel 100 is folded up behind closure elements 110L, 110R and flanks 80, 84. As used herein, "behind" is not limited to the region R bounded by the nonoperative edges 120 of the zip halves, but instead means in the direction of arrow B. The effective lateral dimension $D_{1,EFF}$ of the sling, which is the dimension perceived by the patient, is the nonconvoluted distance from sling edge 56 to sling edge 58. The width W of interflank panel 100 does not contribute to the effective dimension $D_{1,EFF}$. The effective lateral dimension of the sling as seen in FIG. 5 is the minimum lateral dimension of the sling achievable with the described closure elements and interflank panel. The minimum dimension may also be referred to as the closed dimension. However the actual dimension, by definition, includes interflank panel width W even when the panel is folded up behind the closure elements and flanks. As a result the effective dimension $D_{1,EFF}$, is less than the actual dimension $D_{1,ACT}$. By contrast, with the closure elements released from each other as in FIGS. 3 and 4 (and FIG. 6) the effective dimension $D_{1,EFF}$ equals the actual dimension $D_{1,ACT}$. The effective lateral dimension of the sling as seen in FIG. 3-4 (and FIG. 6) is the maximum lateral dimension of the sling achievable with the described closure elements and interflank panel. This dimension may also be referred to as the open dimension of the sling.

In the examples in this specification, when the sling is at a lateral dimension smaller than its maximum lateral dimension, the folded up, excess portion of the interflank panel material is on the patient facing side PF of the sling, next to the patient. However the sling could be constructed so that the excess material is on the back side of the sling.

Referring principally to FIGS. 4-5 selected portions of the sling can be made visually distinctive in order to indicate its effective dimension to an observer. For example, the material of interflank panel 100 may be colored red. When the red color is visible (FIG. 4), its visibility indicates that the sling is at its maximum or open lateral dimension. When the red color is not visible (FIG. 5), the sling is at its minimum or closed lateral dimension. Alternatively, color can be applied to the zip halves or to the material in the immediate vicinity of the zip halves so that the color appears as longitudinally extending stripes. When the colored stripes are close together they indicate that the sling is at its closed or minimum dimension. When the stripes are spatially separated they indicate that the sling is at its open or maximum dimension. The color coding may also be useful for indicating which left and right closure elements are preferred to be secured to each other (even though nonpreferred connections can be made). If the sling is manufactured such that not all the left closure elements are compatible with all the right closure elements, the color coding can be used to indicate which left and right closure elements are compatible with each other.

The direction in which the closure elements extend is referred to as a closure direction. In the foregoing example the closure direction is the longitudinal direction because the closure elements, i.e. zip halves 110LZ, 110RZ, extend longitudinally along the sling. The dimension of interest, i.e. the adjustable dimension, is the dimension in the lateral direction. Additionally or alternatively, the dimension of interest could be the longitudinal dimension $D_2$. Speaking generally, the closure elements extend in a closure direction, and the effective dimension is perpendicular to the closure direction.

FIGS. 7A-7D are views similar to those of FIGS. 4-5 but showing an embodiment in which interflank panel 100 comprises multiple interflank segments and multiple closure elements. In the illustrated embodiment the interflank segments include a medial section or segment 100M and one or more pairs of intermediate sections or segments laterally between the medial segment and the left and right flanks 80, 84. The intermediate segments of FIGS. 7A-7D are a first left intermediate segment 100-$IL_1$ extending laterally leftwardly from the medial segment, a second left intermediate segment 100-$IL_2$ extending laterally leftwardly from the first left intermediate segment to the left flank 80, a first right intermediate segment 100-$IR_1$ extending laterally rightwardly from the medial segment, and a second right intermediate segment 100-$IR_2$ extending laterally rightwardly from the first right intermediate segment to the right flank 84. In general, on either side (left or right) of the medial segment, the intermediate segment closest to the medial segment is of order one, the intermediate segment next (second) closest to the medial segment (if any) is of order two, the intermediate segment third closest to the medial segment (if any) is of order three, and so forth. The numerical subscript of the reference numerals indicates the order of the segment. Lower order segments can also be thought of as being laterally inboard of higher order segments; higher order segments can be thought of as being laterally outboard of lower order segments. A vertical hash mark is used in the illustrations to indicate a notional boundary between adjacent segments.

The embodiment of FIGS. 7A-7D also includes additional closure elements in comparison to the embodiment of FIGS. 4-5. These include a first left intermediate closure element 110-$CL_1$, a second left intermediate closure element 110-$CL_2$, a first right intermediate closure element 110-$CR_1$, and a second right intermediate closure element 110-$CL_2$. Each closure element, including closure elements 110L and 110R, has an order associated with it. The closure elements 110-$CL_1$ and 110-$CR_1$ closest to the medial segment are of first order; the closure elements next closest to the medial segment 110-$CL_2$ and 110-$CR_2$ are of second order, and so forth. In the illustrations order is indicated by different crosshatching, positively sloped for first order, horizontal for second order, negatively sloped for third order. In general, on either side (left or right) of the medial segment, the intermediate closure element closest to the medial segment is of order one, the intermediate closure element next (second) closest to the medial segment (if any) is of order two, the intermediate closure element third closest to the medial segment (if any) is of order three, and so forth. The numerical subscript of the reference numerals indicates the order of the segment. Lower order closure elements can also be thought of as being laterally inboard of higher order closure elements; higher order closure elements can be thought of as being laterally outboard of lower order closure elements.

The operative edges 118 of the zip halves face laterally toward centerplane CP of the sling. This specification refers to such an embodiment as a series embodiment to distinguish it from the embodiment of FIGS. 14A-14C, which is referred to as a parallel embodiment.

Closure elements are considered to be compatible with each other if they are securable to each other (and releasable from each other after having been secured together). In one variant of the sling all the right closure elements are compatible with all the left closure elements. In another variant only left and right closure elements of equal order are compatible with each other. One way of achieving incompatibility is by making the teeth of the zip halves different sizes so that they cannot interlock with each other. Unless indicated otherwise, the examples described in this specification are the variant in which all the right closure elements are compatible with all the left closure elements.

In general, the interflank panel comprises a single medial segment, a quantity $n_I$ of left intermediate segments, and an equal quantity $n_I$ of right intermediate segments where $n_I \geq 0$. The interflank panel also includes $n_C$ left intermediate closure elements and an equal quantity $n_C$ of right intermediate closure elements where $n_C = n_I$. The effective dimension is adjustable to one or more intermediate effective dimensions greater than a minimum effective dimension and less than a maximum effective dimension.

Figure 7A:
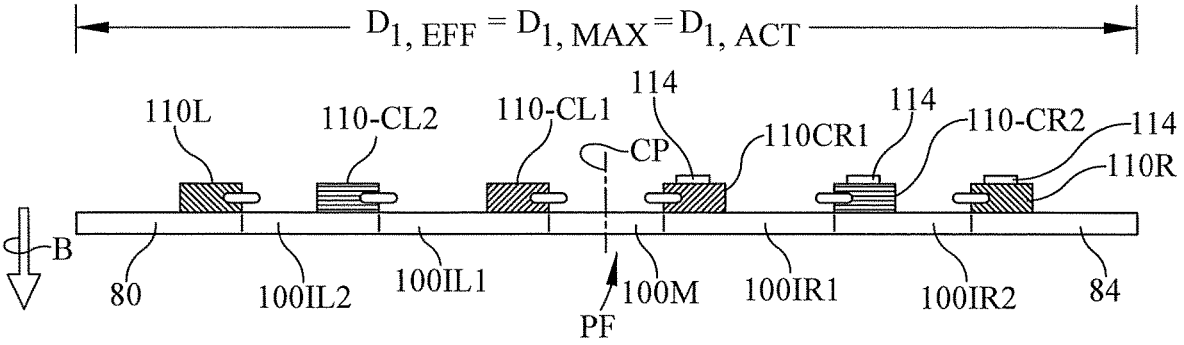
FIGS. 7A, 7B, 7C, and 7D are views similar to those of FIGS. 4-5 showing a series embodiment of the sling in which the interflank panel comprises multiple interflank segments of different order and additional closure elements of different order, the successive FIGS. showing the panel at a progressively reduced lateral dimension.

FIG. 7A shows the sling at its maximum or open effective lateral dimension $D_{1,MAX}$. None of the closure elements are secured to each other. All of the intermediate segments contribute to both $D_{1,ACT}$ and to $D_{1,EFF}$. $D_{1,EFF} = D_{1,MAX} = D_{1,ACT}$.

Figure 7B:
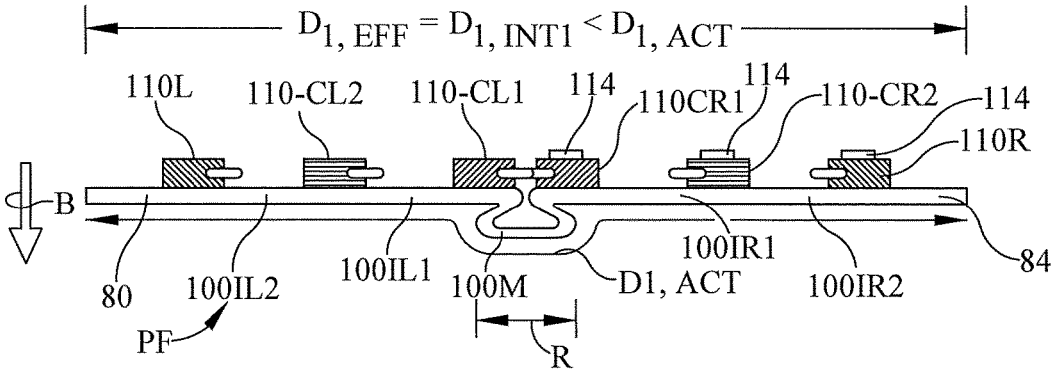

FIG. 7B shows the sling at a first intermediate effective lateral dimension $D_{1,INT1}$. Closure elements 110-$CL_1$ and 110-$CR_1$ are secured together. Medial segment 100M is folded up behind closure elements 110-$CL_1$ and 110-$CR_1$ and behind the first intermediate segments 100-$IL_1$, 100-$IR_1$. As with the nonsegmented embodiment of FIGS. 4-5, "behind" is not limited to the region R bounded by the nonoperative edges 120 of the zip halves, but instead means in the direction of arrow B. All of the interflank segments contribute to $D_{1,ACT}$. All the interflank segments except 100M contribute to the effective dimension. $D_{1,EFF} = D_{1,INT1} < D_{1,ACT}$.

Figure 7C:
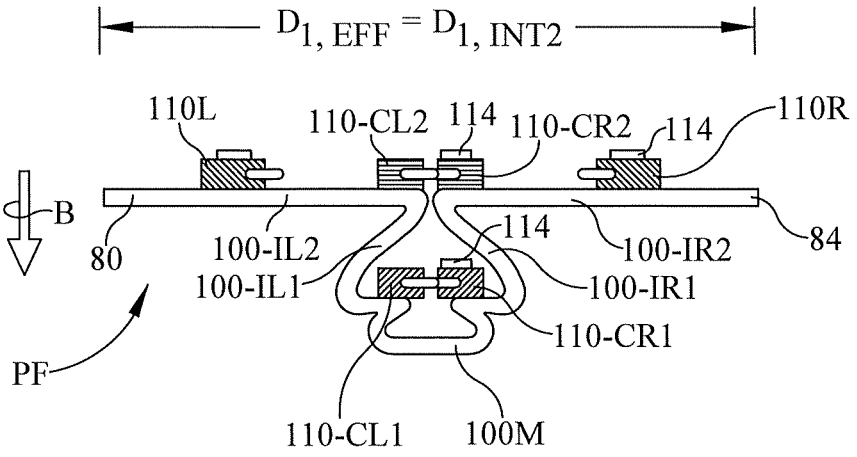

FIG. 7C shows the sling at a second intermediate effective lateral dimension $D_{1,INT2}$. Closure elements 110-$CL_2$ and 110-$CR_2$ are secured together. Closure elements 110-$CL_1$ and 110-$CR_1$ remain secured together. Medial segment 100M and first intermediate segments 100-$IL_1$ and 100-$IR_1$ are folded up behind closure elements 110-$CL_2$ and 110-$CR_2$. Medial segment 100M and first intermediate segments 100-IL1, 100-IR1 contribute to $D_{1,ACT}$, but not to $D_{1,EFF}$. $D_{1,EFF} = D_{1,INT2} < D_{1,INT1} < D_{1,ACT}$.

Figure 7D:
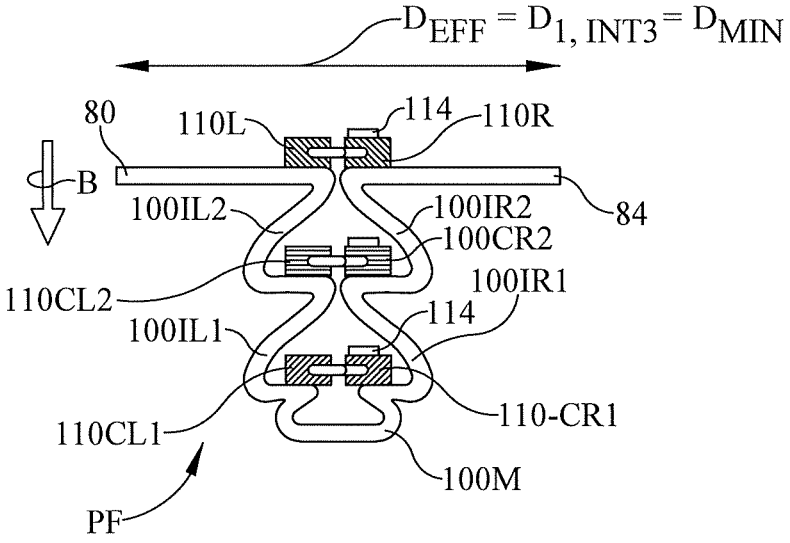

FIG. 7D shows the sling at a minimum intermediate effective lateral dimension $D_{1,INT3}$, which is the minimum lateral dimension $D_{1,MIN}$. Closure elements 110L and 110R are secured together. Closure elements 110-$CL_1$ and 110-$CR_1$ remain secured together as do closure elements 110-$CL_2$ and 110-$CR_2$. Medial segment 100M, first intermediate segments 100-$IL_1$ and 100-$IR_1$, and second intermediate segments 100-$IL_2$ and 100-$IR_2$ are folded up behind closure elements 110L and 110R. Medial segment 100M, first intermediate segments 100-$IL_1$, 100-$IR_1$, and second intermediate segments 100-$IL_2$, 100-$IR_2$, contribute to $D_{1,ACT}$, but not to $D_{1,EFF}$. $D_{1,EFF} = D_{1,INT3} < D_{1,ACT}$.

Figure 8:
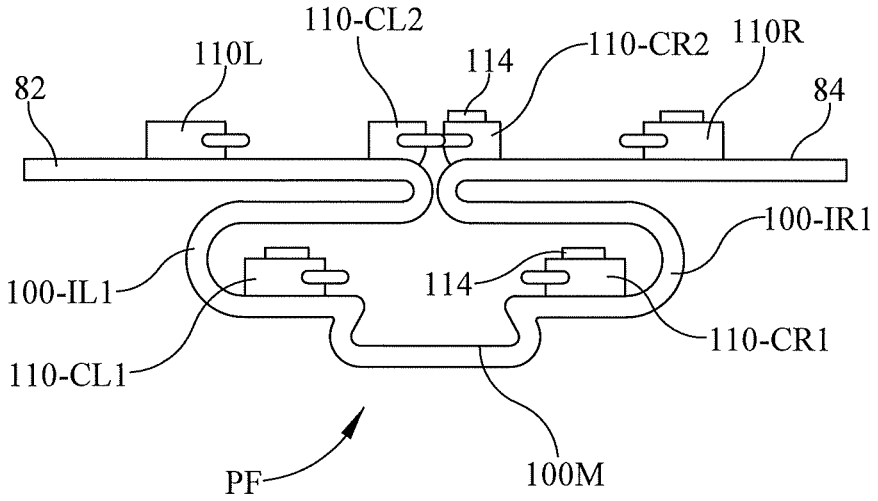
FIG. 8 is a view similar to that of FIGS. 7A-7D in which closure elements which are not being used to establish the effective dimension of the sling are not secured to each other.

FIG. 8 is a view similar to that of FIGS. 7A-7D. The illustration shows that, unlike FIGS. 7A-7D, the closure elements which are not being used to establish the effective dimension of the sling, do not need to be secured to each other.

Figure 9:
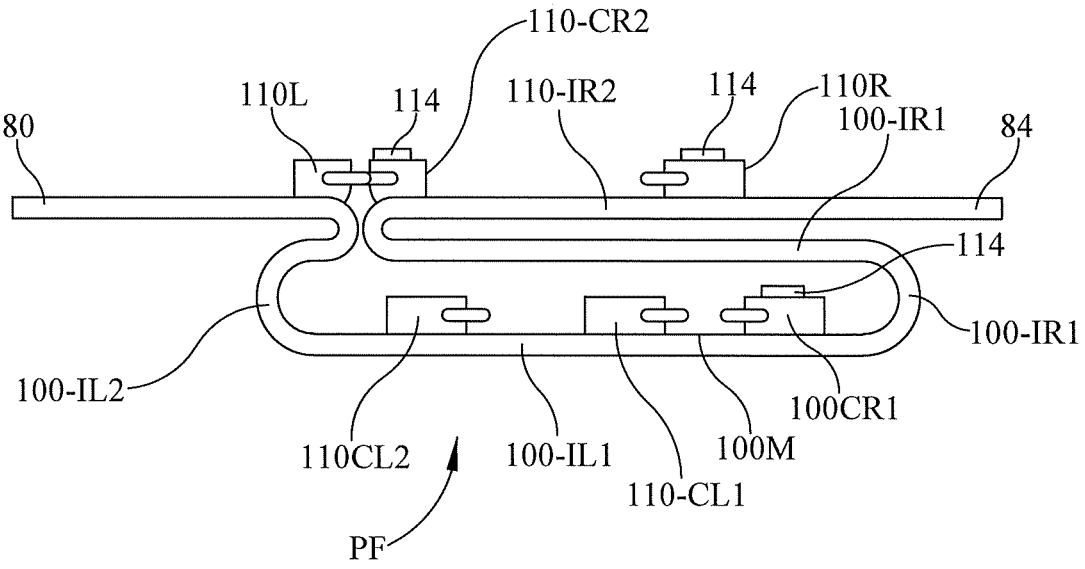
FIG. 9 is a view similar to that of FIG. 8 showing closure elements of different order secured to each other.

FIG. 9 is a view similar to that of FIG. 8 except that closure elements of different order, specifically 110L and 110-$CL_2$, are secured to each other. If all the left closure elements of FIG. 9 are compatible with all the right closure elements, the securement arrangements of the following table can be obtained.

TABLE 1

| Connected Closure Elements (zip halves) | Size |
|---|---|
| None | Maximum |
| $110_L$, $110_R$ | Minimum |
| 110-$CL_2$, 110-$CR_2$ | |
| 110-$CL_1$, 110-$CR_1$ | |
| 110-$CL_1$, 110R | |
| 110-$CR_1$, 110L | |
| 110-$CL_2$, 110R | |
| 110-$CR_2$, 110L | |
| 110-$CL_2$, 110-$CR_1$ | |
| 110-$CL_1$, 110-$CR_2$ | |

With the multi-segmented arrangement illustrated in FIGS. 7A-7D and 8-9 a multitude of discrete effective lateral dimensions less than the maximum lateral dimension can be achieved depending on which closure elements are secured to each other and the quantity and widths of the interflank segments. For example the sling adjusted as seen in FIG. 7D can be used for patients classified as "small" while the same sling adjusted as seen in FIGS. 7C, 7B, and 7A can be used for patients classified as "medium", "large", and "extra large" respectively. The sling is designed so that when the closure elements are secured to each other and the sling is used as intended (to bear the weight of a patient within the rated load capacity of the sling) the closure elements will not separate from each other even though the sling is bearing a patient's weight (force of gravity) acting on the sling with a vertically downwardly oriented component.

Figure 10:
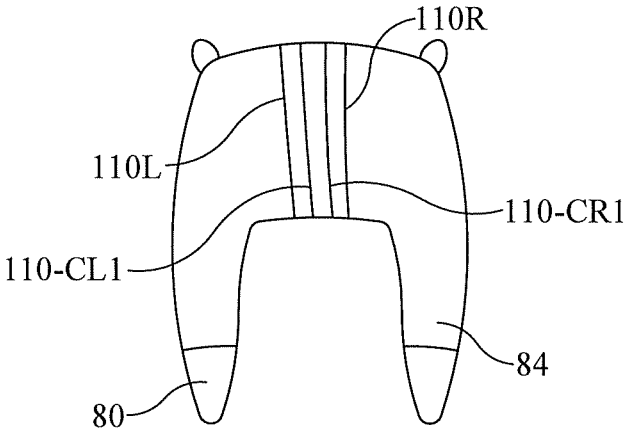
FIGS. 10 and 11 are a plan view of the patient face of a sling and a perspective view of a portion of the sling whose closure elements are zip halves colored to indicate the effective lateral dimension of the sling.
Figure 11:
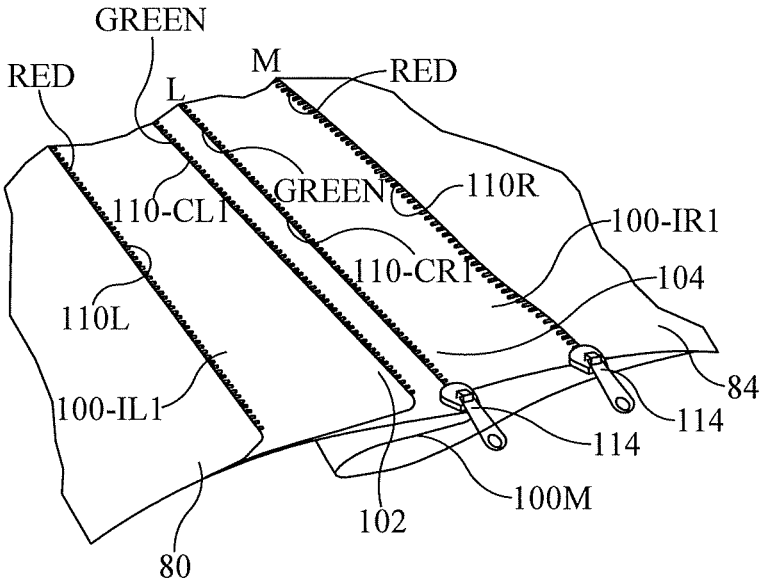

The concept of making selected portions of the sling visually distinctive in order to indicate its effective dimension to an observer, as explained in connection with FIGS. 4-5, can be extended to the embodiments in which the interflank panel includes multiple interflank segments and multiple closure elements (FIGS. 7A-7D, and 8-9 described above, and FIGS. 14A-14C and 15 described below). FIGS. 10-11 show an example in which the interflank panel 100 includes a medial segment 100M, a left intermediate segment 100-$IL_1$ extending laterally leftwardly from the medial segment to the left flank 80, and a right intermediate segment 100-$IR_1$ extending laterally rightwardly from the medial segment to the right flank 84. Compatible closure elements 110-$CL_1$ and 110-$CR_1$ (illustrated as zip halves) or the sling material in the vicinity of those closure elements are green and give the impression of longitudinally extending green stripes. Compatible closure elements 100L and 100R or the sling material in the vicinity of those closure elements are red and give the impression of longitudinally extending red stripes.

When neither the green nor the red closure elements are connected to each other, both green stripes and both red stripes are visible, indicating that the sling is at its maximum or open lateral dimension and is compatible with a "Large" patient. When only the green closure elements are connected to each other, both red stripes are visible and the green stripes appear as a single stripe (or closely separated stripes). This indicates that the sling is at an intermediate lateral dimension and is compatible with a "Medium" patient. When the red closure elements are connected to each other, the green stripes are not visible (irrespective of whether or not the green elements are connected to each other) and the red stripes appear as a single stripe (or closely separated stripes). This indicates that the sling is at its minimum or closed lateral dimension and is compatible with a "Small" patient. If a green closure element is connected to a red closure element, a red stripe and a green stripe are visible close to each other, and a single red stripe is visible separated from the red/green combination.

Figure 12:
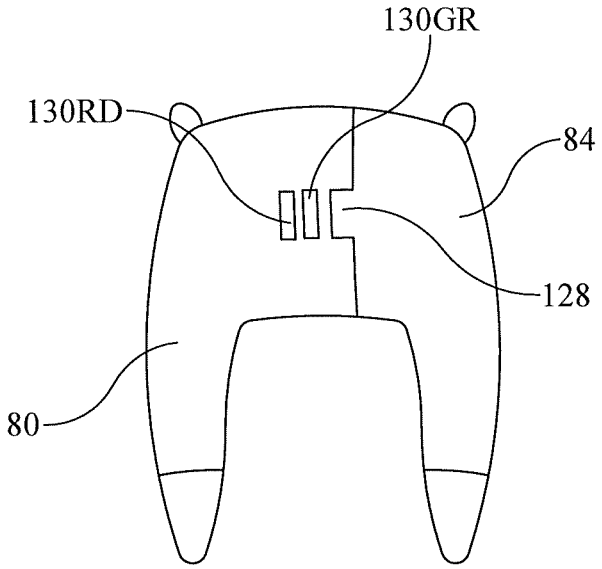
FIGS. 12-13 are views similar to those of FIGS. 10-11 showing a sling whose closure elements are male and female components of a hook and loop fastener and in which fastener patches are colored to indicate the effective lateral dimension of the sling.
Figure 13:
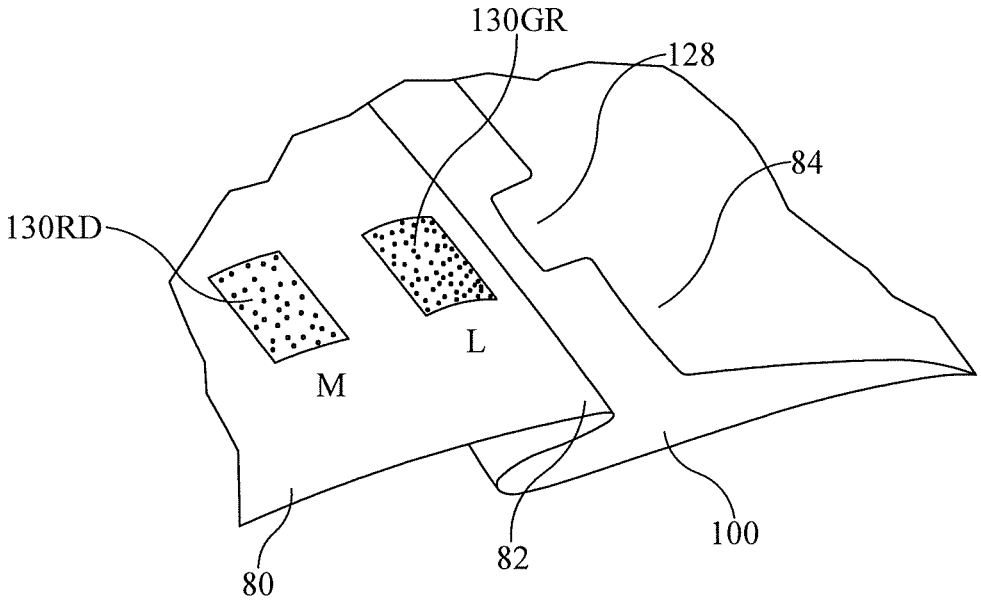

FIGS. 12-13 show a color coding arrangement used on a sling whose closure relies on hook and loop closure elements. The illustrated sling includes a left flank 80, a right flank 84 and an interflank panel 100 (not visible in FIG. 12). Exactly one right closure element in the form of a tab 128 extends laterally from the right flank. At least two left closure elements reside on the left flank. The illustrated embodiment includes two left closure elements, a first left closure element in the form of a green colored attachment patch 130GR and a second left closure element in the form of a red colored attachment patch 130RD. Second patch 130RD is laterally spaced from first patch 130GR so that second patch 130RD is laterally further away from left end 82 of left flank 80 than is first patch 130GR. In one alternative the exactly one right closure element is a more longitudinally extensive strip, the first left closure element is a more longitudinally extensive strip, and the second left closure element is a more longitudinally extensive strip. In another alternative the exactly one right closure element is a set of longitudinally distributed tabs, the first left closure element is a first set of longitudinally distributed patches and the second left closure element is a second set of longitudinally distributed patches.

When the tab is not secured to either green patch 130GR or red patch 130RD, both patches are visible, indicating that the sling is at its maximum or open lateral dimension and is compatible with a "Large" patient. (In FIG. 13 the intersegment panel is depicted as being folded, however the closure elements are not secured to each other and therefore cannot react a laterally directed force.) When the tab is secured to the first (green) patch, only the red patch is visible indicating that the sling is at an intermediate lateral dimension and is compatible with a "Medium" patient. When the tab is secured to the second (red) patch, neither the red patch nor the green patch is visible, indicating that the sling is at its minimum or closed lateral dimension and is compatible with a "Small" patient.

Figure 14A:
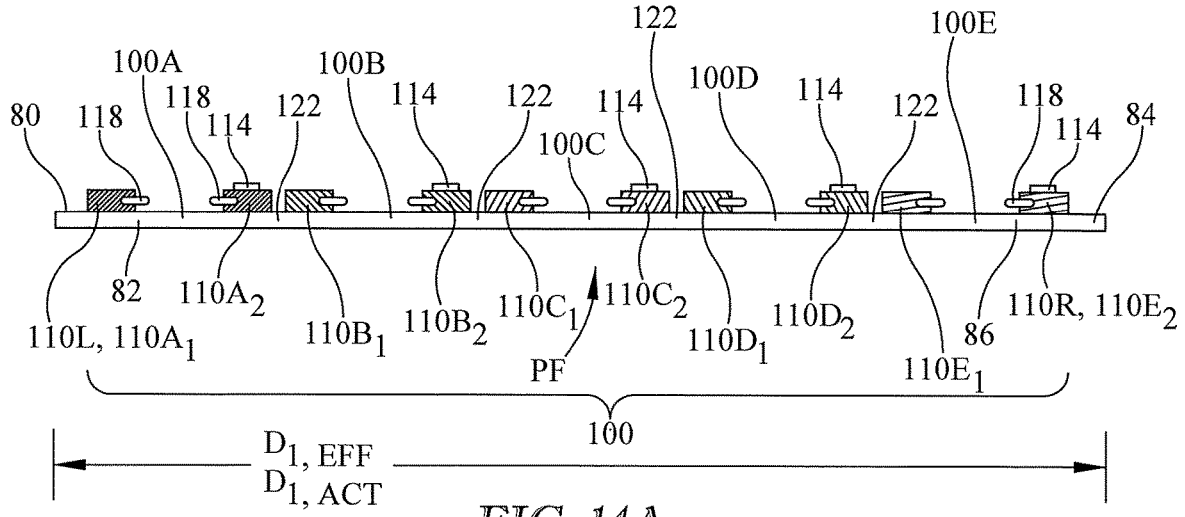
FIGS. 14A-14C are views similar to those of FIGS. 7A-7D showing a parallel embodiment of the sling in which the interflank panel comprises multiple interflank segments and additional closure elements, the successive FIGS. showing the panel at a progressively reduced lateral dimension.
Figure 14B:
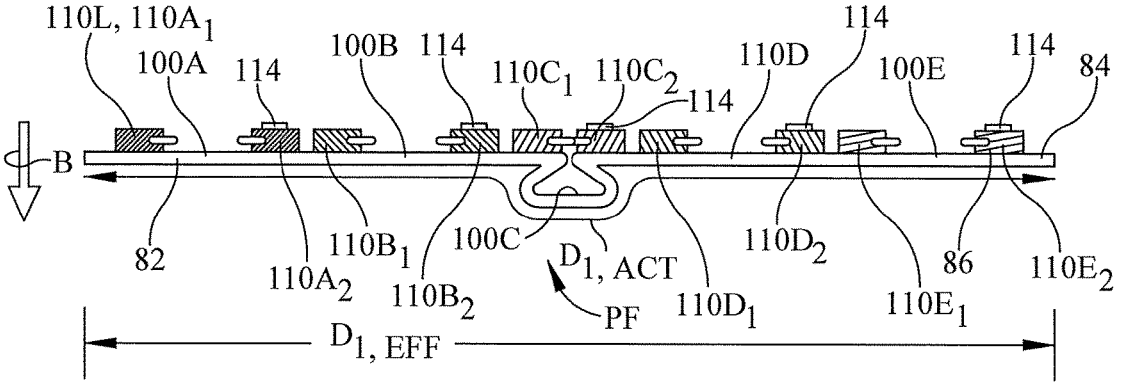
Figure 14C:
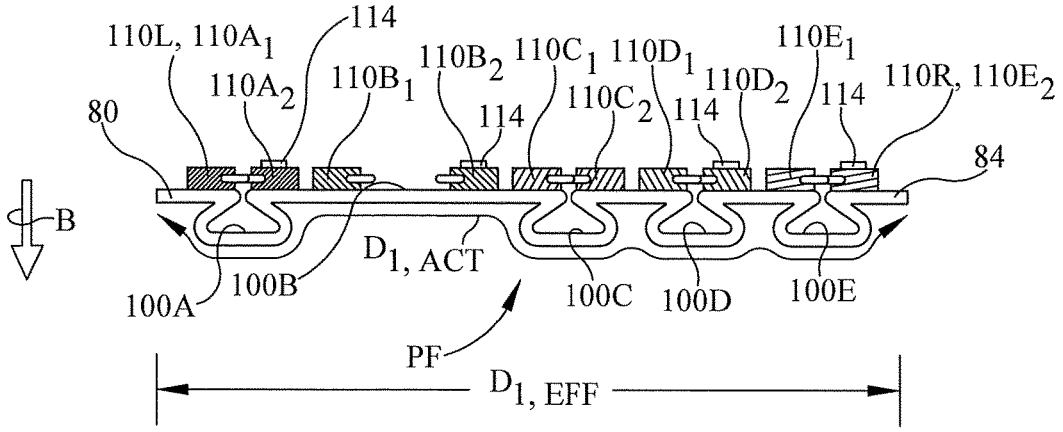

FIGS. 14A-14C are views of an embodiment similar to the embodiment of FIGS. 4-5 in that it includes a pair of closure elements (zip halves 110L/110$A_1$ and 110R/100$E_2$, described in more detail below) whose operative edges, when secured to each other, cause the sling to be at its minimum lateral dimension. The embodiment of FIGS. 14A-14C is also similar to that of FIGS. 7A-7D and 8-9 in that interflank panel 100 comprises multiple interflank segments and multiple closure elements. The embodiment of FIGS. 14A-14C is referred to a a parallel embodiment to distinguish it from the series embodiment of FIGS. 7A-7D and 8-9. The interflank segments of the illustrated embodiment are first through fifth segments 100A, 100B, 100C, 100D, 100E which are laterally between flanks 80, 84.

The embodiment of FIGS. 14A-14C also includes additional closure elements in comparison to the embodiment of FIGS. 4-5. The additional closure elements are intermediate closure elements 110$A_2$, 110$B_1$, 110$B_2$, 110$C_1$, 110$C_2$, 110$D_1$, 110$D_2$ and 110$E_1$. The closure elements at the left end 82 of left flank 80 and at the right end 86 of right flank 84 are labelled as 110L and 110R as in the series embodiment, and also as 110$A_1$ and 110$E_2$ to maintain consistency with the numbering of the eight additional closure elements (110$A_2$ through 110$E_1$) of FIGS. 14A-14C. Pairs of closure elements which neighbor each other and whose interconnecting features (e.g. the operative edges 118 of a zip half) face toward each other (one left facing (even numbered subscripts) and one right facing (odd numbered subscripts)) are defined as corresponding closure elements. In the illustrations different pairs of corresponding elements are indicated by common crosshatching. Corresponding closure elements are compatible with each other as already defined in connection with FIGS. 7A-7D, 8, and 9 (securable to each other and, once secured together, releasable from each other). Noncorresponding left facing and right facing closure elements, e.g. elements 110$B_1$ and 110$D_2$, may be designed to be compatible with each other or incompatible with each other. Unless indicated otherwise, the examples described in this specification are the variant in which all the right facing closure elements are compatible with all the left facing closure elements. A spacer strip 122 may be present between closure elements having different letter suffixes, e.g. between 110$C_2$ and 110$D_1$ In general, the interflank panel includes m segments and m=1 additional (interflank) closure elements. The lower limit case is m=1, m−1=0, which is the same as the series embodiment of FIGS. 4-5. The effective dimension is adjustable to one or more intermediate effective dimensions greater than a minimum effective dimension and less than a maximum effective dimension.

FIG. 14A shows the sling at its maximum or open effective lateral dimension $D_{1,MAX}$. None of the closure elements are secured to each other. All of the interflank segments contribute to both $D_{1,ACT}$ and to $D_{1,EFF}$. $D_{1,EFF}=D_{1,MAX}=D_{1,ACT}$.

FIG. 14B shows the sling at a first reduced effective lateral dimension $D_{1,RED1}$. Closure elements 110$C_1$ and 110$C_2$ are secured together. Third segment 100C is folded up behind closure elements 110$C_1$ and 110$C_2$. All of the segments, including the folded segment 100C, contribute to actual dimension $D_{1,ACT}$. All the segments except 100C contribute to the effective dimension $D_{1,EFF}$. $D_{1,EFF}=D_{1,RED1}<D_{1,ACT}$.

FIG. 14C shows the sling at a second reduced effective lateral dimension $D_{1,RED2}$. Closure elements 110$C_1$ and 110$C_2$ are secured together as in FIG. 10B. In addition, three other pairs of closure elements are secured to each other (110$A_1$/110L to 110$A_2$; 110$D_1$ to 110$D_2$; and 110$E_1$ to 110$E_2$/110R). $D_{1,EFF}=D_{1,RED2}<D_{1,RED1}<D_{1,ACT}$.

Figure 15:
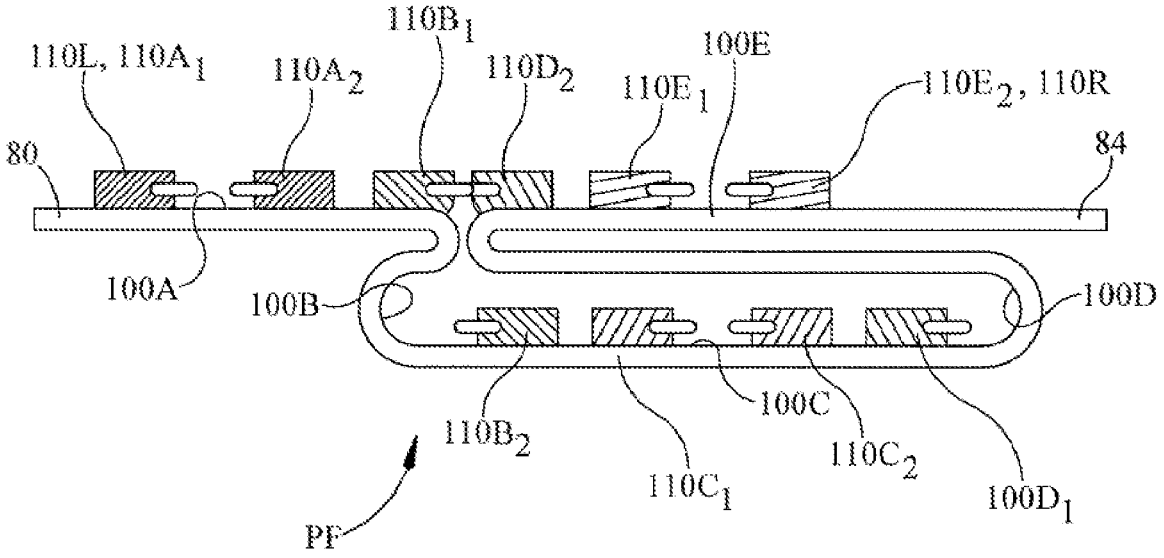
FIG. 15 a view similar to that of FIGS. 14A-14C in which a reduced lateral dimension of the sling has been attained by securing nonadjacent closure elements to each other.

FIG. 15 shows the sling at another reduced effective lateral dimension. The reduced dimension is obtained by securing closure elements 110$B_1$ and 110$D_2$ to each other (bypassing 110$B_2$ and 110$C_2$).

With the multi-segmented arrangement illustrated in FIGS. 14A-14C and 15 a multitude of effective lateral dimensions less than the maximum lateral dimension can be achieved depending on which closure elements are secured to each other, how many closure elements are secured to each other, and the quantity and widths of the interflank segments.

The foregoing describes the use of left and right closure elements without an intervening component to adjust a dimension of a sling. The left closure element can be alternatively referred to as a right facing closure element, and the right closure element can be alternatively referred to as a left facing closure element. Zip halves are the predominant examples used so far in this specification. The following paragraphs describe a nonexhaustive set of alternatives in the context of a nonsegmented sling, i.e. one in which the interflank panel is not broken down into medial and intermediate segments.

Figure 16:
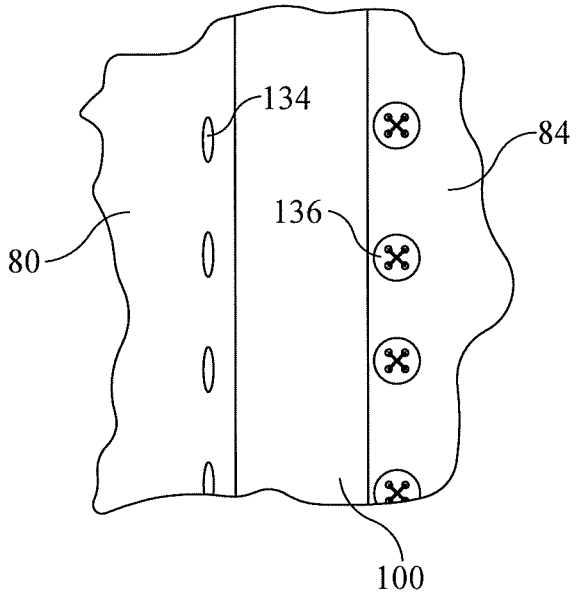
FIGS. 16, 17, 18 and 19 are views of a portion of a sling showing a selection of alternative closure elements which can be secured to each other without the assistance of an intervening component.

In FIG. 16 the left (right facing) closure element is a row of buttonholes 134 and the right (left facing) closure element is a row of buttons 136.

Figure 17:
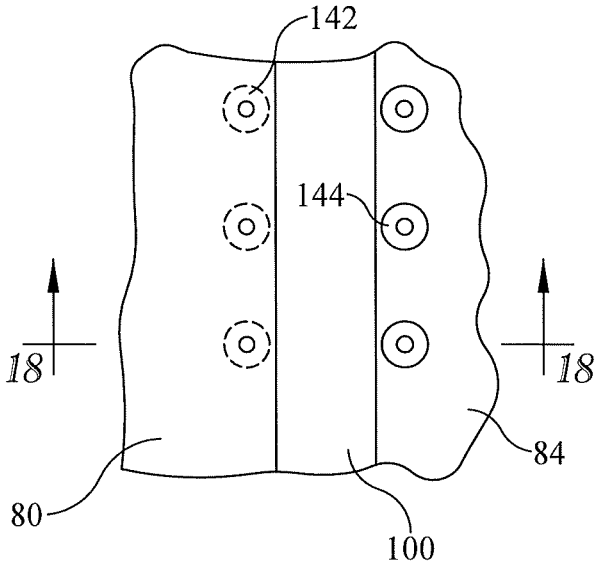
Figure 18:
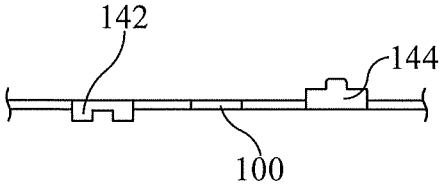

In FIGS. 17-18, the left (right facing) closure element is a row of female snap receptacles 142 and the right (left facing) closure element is a row of male snap studs 144.

Figure 19:
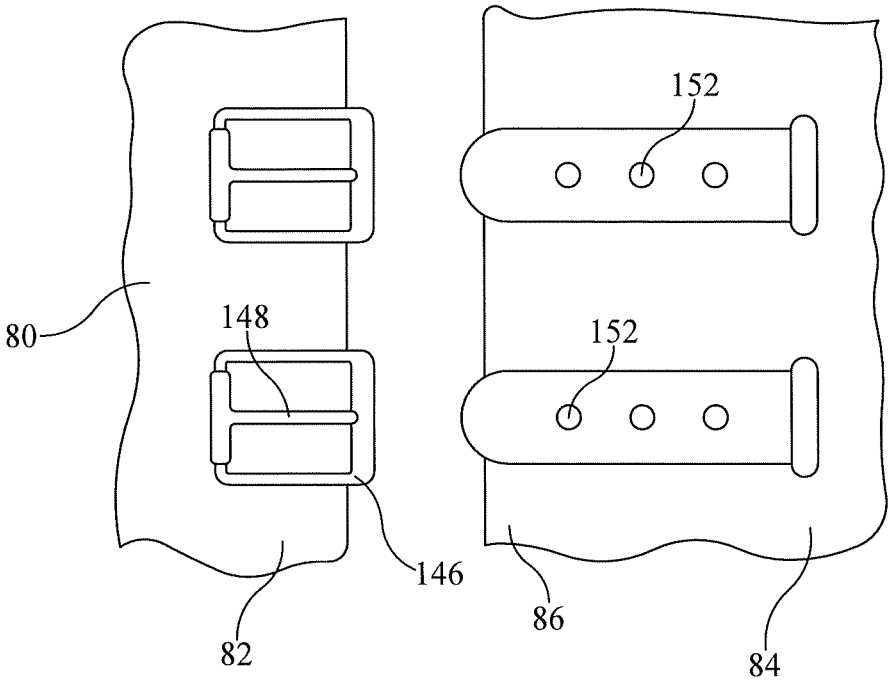

In FIG. 19, the left (right facing) closure element is a row of buckles frames 146, each attached to the left end 82 of left flank 80 and each including a tongue 148. The right (left facing) closure element is a strap 150 with holes 152 for receiving the tongue.

Sling adjustability can also be effected by left and right closure elements that require an intervening component. The following paragraphs describe a nonexhaustive set of such closure elements.

Figure 20:
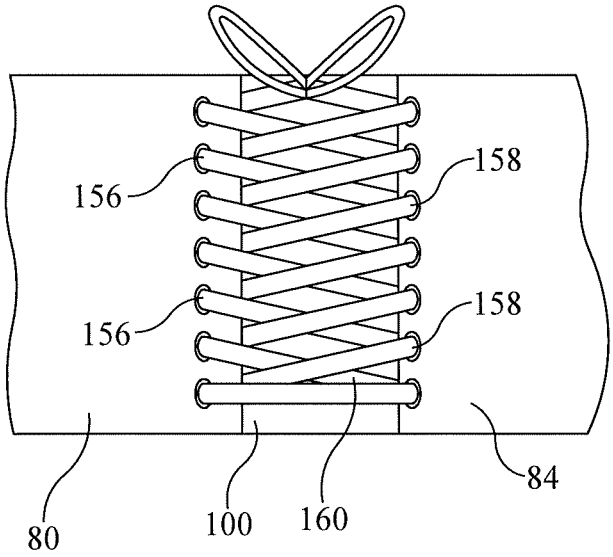
FIGS. 20, 21, 22, 23 and 24 are views of a portion of a sling showing a selection of alternative closure elements which can be secured to each other with the assistance of an intervening component.

In FIG. 20 the left (right facing) closure element is a row of left eyelets 156, and the right (left facing) closure element is a row of right eyelets 158. The intervening component element is a lace 160.

Figure 21:
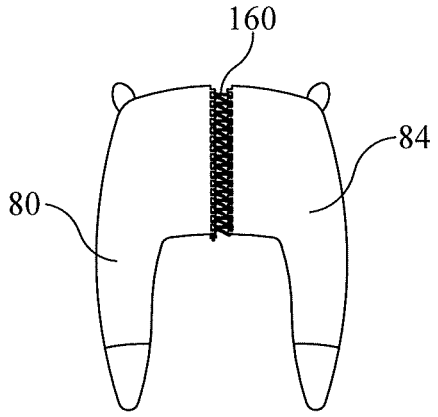
Figure 22:
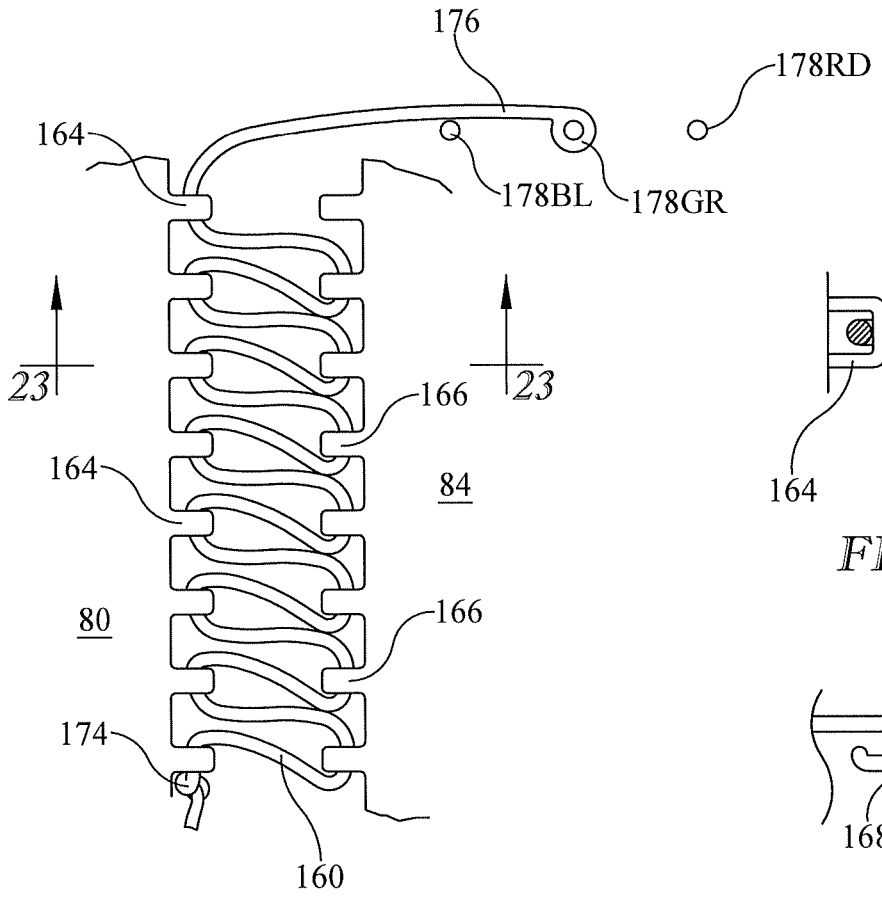
Figure 23:
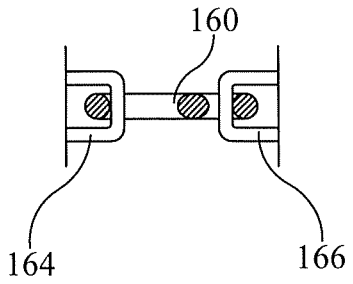
Figure 24:
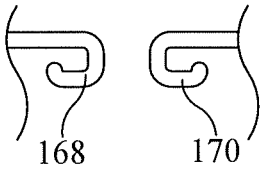

FIGS. 21-23 show a corset-like arrangement in which the left (right facing) closure element is a row of left loops 164, and the right (left facing) closure element is a row of right loops 166. The intervening component is a lace 160. Alternatively, as seen in FIG. 24, the left and right closure elements are each a row of hooks 168, 170. Either way the lace has a fixed end 174 and a free end 176. The free end is secured to one of two or more terminals 178BL (black), 178GR (green), (red) 178RD to establish how tightly the left and right flanks 80, 84 are drawn toward each other, thereby establishing the effective lateral dimension of the sling. The optional color coding of the terminals indicates large, medium and small sizes.

Figure 25:
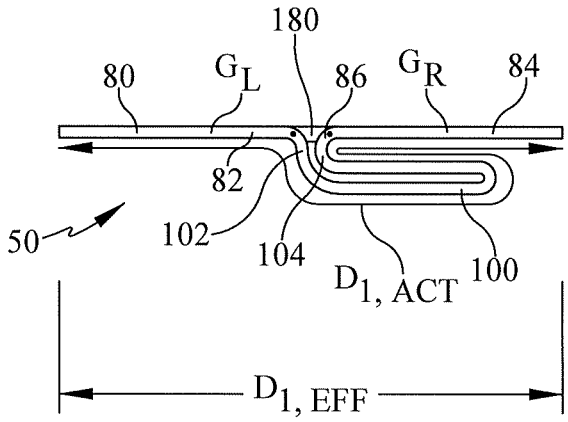
FIG. 25 is a cross sectional view similar to FIG. 5 showing a frangible closure member in an unbroken state.

Referring to FIG. 25, another embodiment of a size adjustable sling includes a panel assembly 50 including a left flank 80 with a left end 82, a right flank 84 with a right end 86, and an interflank panel 100. The interflank panel has a left extremity 102 permanently joined to the left end of the left flank and a right extremity 104 permanently joined to the right end of the right flank.

Figure 26:
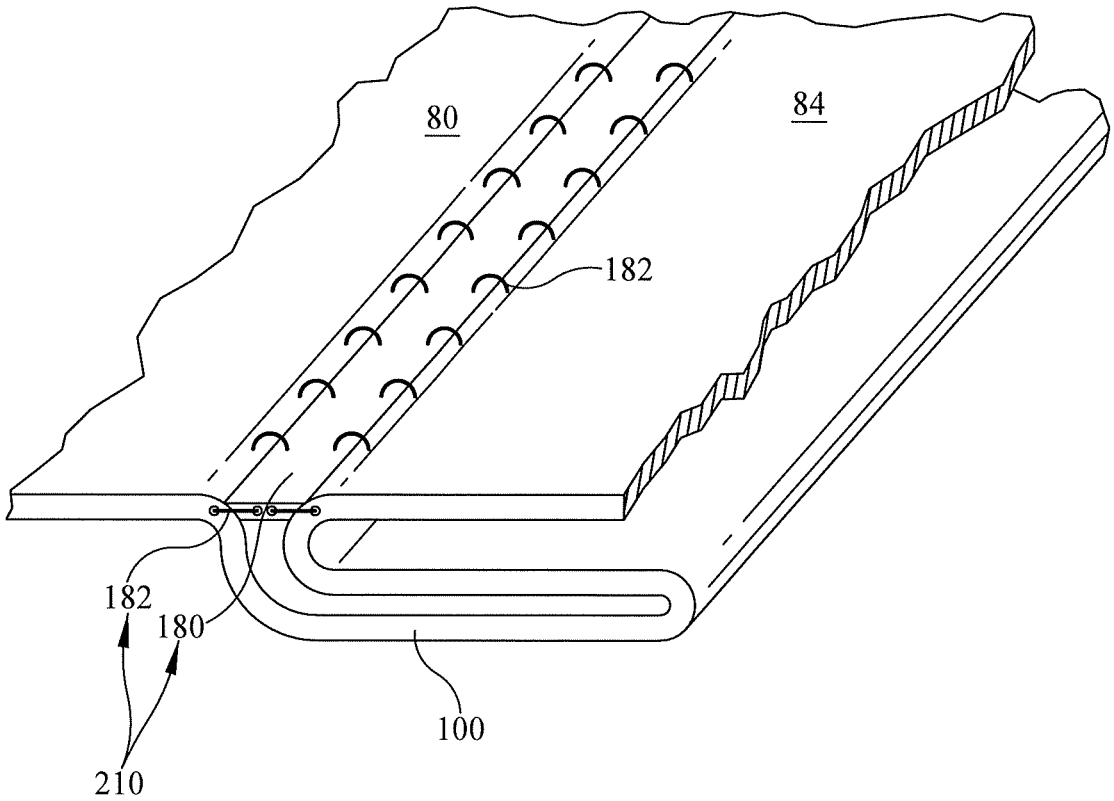
FIG. 26 is a perspective view showing the frangible closure member of FIG. 25 in the unbroken state.

Referring additionally to FIG. 26 a frangible closure member 210 secures the left flank to the right flank. The frangible closure member in the example of FIGS. 25-26 is a strip of material 180 sewn to the left end of the left flank and to the right end of the right flank by a thread 182. The closure member is frangible in the sense that it is designed to be breakable only by an influence, such as a force or forces, which are purposefully concentrated on the closure member. The closure member is designed so that it will remain intact under other influences, such as a load which is distributed on the sling and which has a vertically downwardly directed component. An example of such an influence is part or all of a patient's weight when borne by the sling.

An influence is considered to be purposefully concentrated on the closure member if the influence is applied with the goal of breaking the closure member. One example is a tearing force exerted by a person who grasps each flank near the upper edge of the sling, e.g. at locations $G_L$, $G_R$, and pulls in opposite directions to tear the closure member. Another example is the use of scissors to cut the closure member. As demonstrated by these two examples, the closure member may be designed to be broken with a tool or without a tool. If the closure member is designed to be broken with a tool its design may also provide for breakage without a tool.

Figure 27:
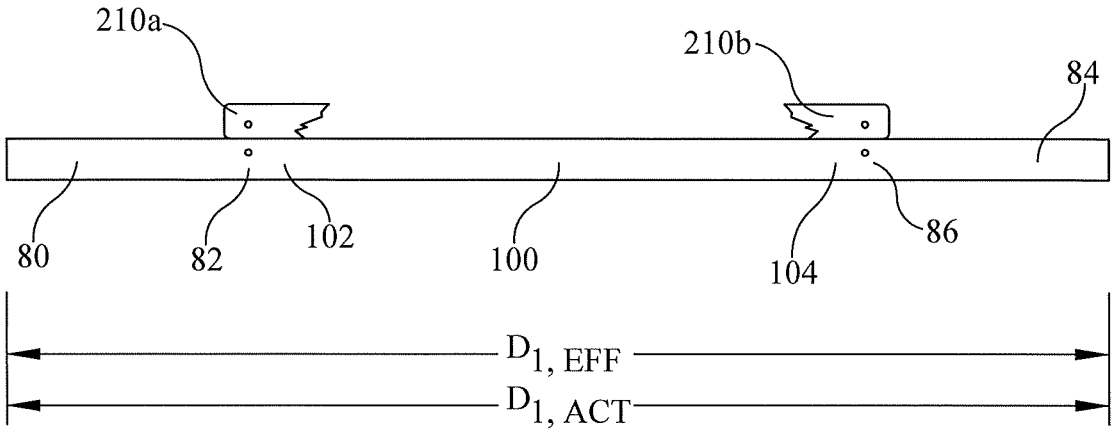
FIG. 27 is a view similar to that of FIG. 25 showing the frangible closure member in a broken state.

FIG. 27 shows the sling after the closure member has been broken. In the example of FIG. 27 the act of breaking the closure member has left behind two remnants, 210*a*, 210*b* as a result of the formerly intact strip 210 having been torn or cut. In another example, not shown, the breaking of the closure member could be effected by breakage of one or both threads 182. A comparison of FIG. 25 to FIG. 27 shows that the sling has a smaller effective dimension $D_{1,EFF}$ when the frangible closure member is intact and has a larger effective dimension when the closure member is broken.

The frangible closure member is a sacrificial or one-way closure member in the sense that breakage of the closure member is irreversible. This is in contrast to the closure elements of the embodiments described in connection with FIGS. 1-24 in which the closure elements can be readily re-secured to each other after having been released from each other. Accordingly, the sling with the frangible closure member may be designed as a single-patient sling. That is, the sling is designed to be disposed of after it is no longer needed for the patient to whom its size had been adjusted. Two exceptions are that a sling which has been used as seen in FIG. 25 can be used again for another "small" patient, and the sling which has been used as seen in FIG. 27 can be used again for another "large" patient.

Figure 28:
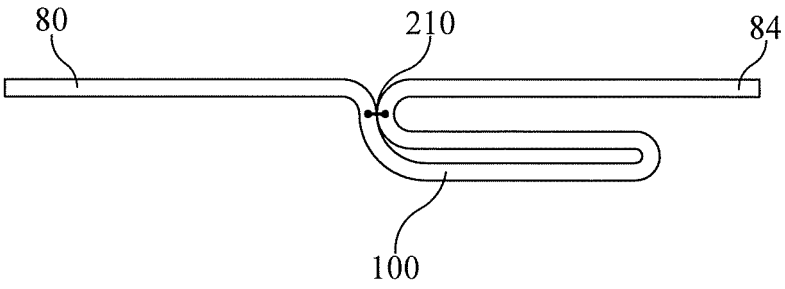
FIG. 28 is a view similar to that of FIG. 25 showing an alternative frangible closure member in its unbroken state.

FIG. 28 shows another embodiment in which the frangible closure member 210 is a thread 182. In yet another embodiment, not illustrated, the frangible closure member is a heat sealed "weld" joint that can be cut with scissors.

Figure 29A:
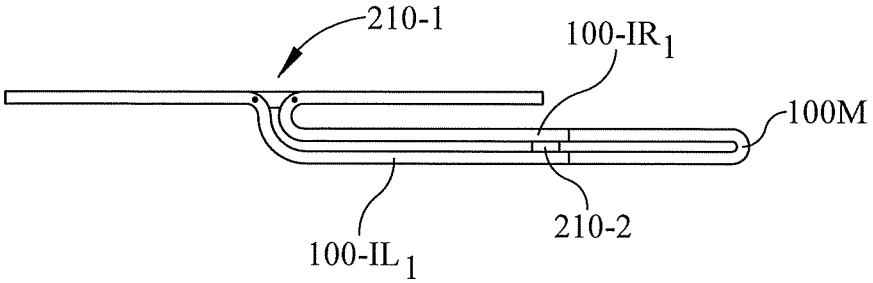
FIGS. 29A, 29B, and 29C is a set of views similar to the views of FIGS. 25 and 27 showing multiple frangible closure members, the successive FIGS. showing the interflank panel at a progressively expanded lateral dimension.
Figure 29B:
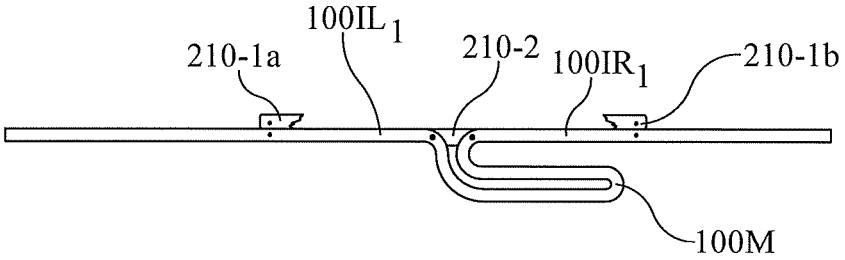
Figure 29C:
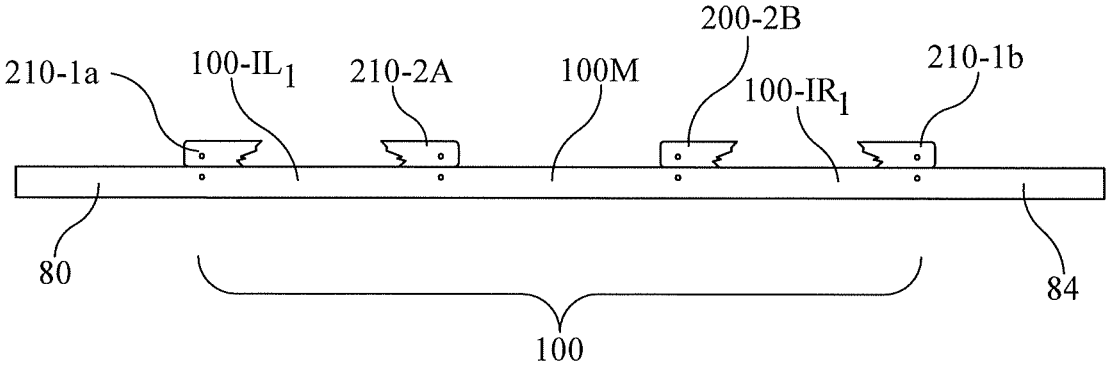

FIGS. 29A-29C are views similar to FIGS. 25 and 27 except that interflank panel 100 comprises a medial segment 100M and one or more pairs of intermediate sections or segments laterally between the medial segment and the left and right flanks 80, 84. The example shows one pair of intermediate segments, a left intermediate segment 100-$IL_1$ extending laterally leftwardly from the medial segment, and a right intermediate segment 100-$IR_1$ extending laterally rightwardly from the medial segment.

Referring to FIG. 29A, a first frangible closure member 210-1 secures left flank 80 to right flank 84. A second frangible closure member 210-2 secures left intermediate segment 100-$IL_1$ to right intermediate segment 100-$IR_1$. The effective lateral dimension of the sling $D_{1,EFF}$, is its minimum lateral dimension.

FIG. 29B shows the sling after frangible closure member 210-1 has been broken, leaving behind two remnants, 201-1*a* and 210-1*b*. The effective lateral dimension of the sling $D_{1,EFF}$, is an intermediate lateral dimension, which is larger than the minimum dimension of FIG. 29A.

FIG. 29C shows the sling after frangible closure member 210-2 has been broken, leaving behind two additional remnants, 201-2*a* and 210-2*b*. The effective lateral dimension of the sling $D_{1,EFF}$, is its maximum lateral dimension, which is larger than the intermediate dimension of FIG. 29B.

In the embodiment of FIGS. 29A-29C the sling includes an additional frangible closure member for each pair (one left and one right) of intermediate segments. For example the embodiment specifically shown in FIGS. 29A-29C includes one pair of intermediate segments and one closure member 210-2 in addition to closure member 210-1. A sling similar to that of FIGS. 29A-29C which includes n left intermediate segments and n right intermediate segments includes n+1 closure members, one for each of the n left and right intermediate segment pairs and one for securing the left flank to the right flank.

In the embodiments of FIGS. 25-29C, the frangible closure member 210 or 210-1 can be viewed as holding the flank ends in close proximity to each other. The closure member is irreversibly breakable thereby enabling the flank ends to separate from each other and enlarging an effective dimension of the sling. The embodiment of FIGS. 29A-29C includes additional frangible closure members which can be viewed as holding a left intermediate segment and a right intermediate segment in close proximity to each other. In a specific embodiment the left intermediate segments can be numbered 1 through n and the right intermediate segments can be similarly numbered 1 through n with the number 1 corresponding to the segments closest to the medial segment, the number 2 corresponding to the next most outboard segments, and so forth. A frangible closure member, in addition to member 210-1, is provided for each pair of intermediate segments, and each of these additional closure members can also be numbered 1 through n. Closure member 210-1 holds the flanks in close proximity to each other until broken. Like numbered left and right intermediate segments are held in close proximity to each other by the same-numbered closure member until the member is broken.

Although this disclosure refers to specific embodiments, it will be understood by those skilled in the art that various changes in form and detail may be made without departing from the subject matter set forth in the accompanying claims.

The terms "substantially" and "about" may be used herein to represent the inherent degree of uncertainty that may be attributed to any quantitative comparison, value, measurement or other representation. These terms are also used herein to represent the degree by which a quantitative representation may vary from a stated reference without resulting in a change in the basic function of the subject matter at issue.

We claim:

1. A sling for supporting a subject comprising:

a panel assembly including a left flank with a left end, a right flank with a right end, and an interflank panel, the interflank panel having a left extremity joined to the left end and a right extremity joined to the right end and a width W; and a frangible closure member which secures the left flank to the right flank and adjusts an effective dimension of the sling between an effective dimension $D_{1,EFF}$ when the frangible closure member secures the left flank and right flank to each other and an actual dimension $D_{1,ACT}$ when the left flank and right flank are released from each other by breaking the frangible closure member, wherein:

the interflank panel includes a medial segment, at least one intermediate segment, and at least one additional frangible closure member; and the frangible closure member extends in a closure direction, and a difference between $D_{1,EFF}$ and $D_{1,ACT}$ is the width W of the interflank panel along the closure direction.

2. The sling of claim 1 wherein the closure member comprises a strip of material.

3. The sling of claim 1 wherein the closure member comprises a thread.

4. The sling of claim 1 wherein the closure member is not breakable by forces attributable to a downwardly acting load supported by the sling.

5. The sling of claim 1 wherein the closure member is breakable only by a force or forces purposefully concentrated on the closure member.

6. The sling of claim 1 wherein the closure member is breakable without a tool.

7. The sling of claim 1 wherein the closure member is not breakable without the use of a tool.

8. A sling for supporting a subject comprising:

a panel assembly including a left flank with a left end, a right flank with a right end, and an interflank panel, the interflank panel having a left extremity joined to the left end and a right extremity joined to the right end and a width W; and a frangible closure member which holds the flank ends in close proximity to each other and which is irreversibly breakable thereby enabling the flank ends to separate from each other, wherein the frangible closure member extends in a closure direction, and a difference between $D_{1,EFF}$ and $D_{1,ACT}$ is the width W of the interflank panel along the closure direction, wherein:

the interflank panel includes a medial segment, at least one intermediate segment, and at least one additional frangible closure member.

* * * * *